US007089695B2

(12) United States Patent
Fast et al.

(10) Patent No.: US 7,089,695 B2
(45) Date of Patent: Aug. 15, 2006

(54) HINGED LABEL HOLDER

(75) Inventors: Jacob Fast, Boca Raton, FL (US); Michael G. Lowry, Boca Raton, FL (US)

(73) Assignee: Fast Industries, Ltd., Fort Lauderdale, FL (US)

( * ) Notice: Subject to any disclaimer, the term of this patent is extended or adjusted under 35 U.S.C. 154(b) by 0 days.

(21) Appl. No.: 10/725,534

(22) Filed: Dec. 3, 2003

(65) Prior Publication Data

US 2005/0081418 A1 Apr. 21, 2005

Related U.S. Application Data

(60) Provisional application No. 60/511,097, filed on Oct. 15, 2003, provisional application No. 60/476,651, filed on Jun. 9, 2003.

(51) Int. Cl.
*G09F 3/00* (2006.01)

(52) U.S. Cl. ..... 40/642.01; 40/657; 40/661

(58) Field of Classification Search ..... 40/642.01, 40/657, 661

See application file for complete search history.

(56) References Cited

U.S. PATENT DOCUMENTS

| | | | | |
|---|---|---|---|---|
| 4,593,824 | A * | 6/1986 | Pfeifer | 211/57.1 |
| 5,421,113 | A | 6/1995 | Gebka et al. | |
| 5,442,872 | A * | 8/1995 | Moser | 40/642.01 |
| 5,456,034 | A | 10/1995 | Lewis et al. | |
| 5,702,008 | A | 12/1997 | Thalenfeld et al. | |
| 5,815,970 | A | 10/1998 | Thalenfeld et al. | |
| 5,826,359 | A | 10/1998 | Thalenfeld et al. | |
| 5,860,239 | A | 1/1999 | Thalenfeld et al. | |
| 5,887,731 | A | 3/1999 | Thalenfeld | |
| 5,901,487 | A | 5/1999 | Thalenfeld et al. | |
| 5,941,003 | A | 8/1999 | Thalenfeld | |
| 5,979,674 | A | 11/1999 | Thalenfeld | |
| 6,141,894 | A | 11/2000 | Thalenfeld et al. | |
| 6,189,247 | B1 * | 2/2001 | Gebka | 40/642.01 |
| 6,269,571 | B1 | 8/2001 | Thalenfeld | |
| 6,279,256 | B1 * | 8/2001 | Norolof et al. | 40/642.01 |
| 6,389,722 | B1 * | 5/2002 | Josefsson et al. | 40/642.01 |
| D461,507 | S | 8/2002 | Nagel | |
| 6,568,112 | B1 | 5/2003 | Lowry et al. | |
| 6,604,310 | B1 * | 8/2003 | Lindstrom et al. | 40/642.01 |

FOREIGN PATENT DOCUMENTS

| | | |
|---|---|---|
| EP | 1314 382 A1 | 5/2003 |
| WO | WO 95/23398 | 8/1995 |

OTHER PUBLICATIONS

Trion Catalog Addendum, pp. 8, 9, 14 and 15.

* cited by examiner

*Primary Examiner*—Gary C. Hoge
(74) *Attorney, Agent, or Firm*—Jacobson Holman PLLC

(57) ABSTRACT

A label holder is hingedly connected to a clip portion grippingly engaged over a transversely extending rod at the distal end of a merchandise aid, such as a scanner hook or the like, or over a plate on the end of a scanner hook enabling the label holder to be moved forwardly to access or position product on the scanner hook, or, in some applications, rearwardly in the event of impact from a passerby. By selecting the properties of the hinge section, the label holder can be temporarily fixed in a selected angular relationship when the scanner hook extends above or below the eye of a viewer to facilitate reading information on labels carried thereby.

24 Claims, 9 Drawing Sheets

HINGED LABEL HOLDER

This is a complete application claiming benefit of provisional application Ser. No. 60/476,651 filed Jun. 9, 2003 and provisional application Ser. No. 60/511,097 Oct. 15, 2003.

BACKGROUND OF THE INVENTION

1. Field of the Invention

This invention relates to merchandising aids, and relates more particularly to a unique design of a label holder or a combination label holder/sign holder that is secured to the end of a merchandise display or scanner hook in a manner that enables the label holder to tip rearwardly if accidentally engaged by a passerby or the like, be tipped forwardly to facilitate adding product to, and removing product from, the merchandise display hook without interference, and be temporarily retained at a rearwardly or forwardly extending angle to the horizontal to facilitate viewing information on the labels carried thereby when the merchandise display or scanner hook on which it is mounted is positioned above or below eye level, respectively.

The label holder portion of the merchandising aid is designed to removably receive adhesive or non-adhesive labels to display consumer information such as descriptions and prices of products, as well as inventory control information, such as barcodes and the like. The merchandising aid of this invention may also include a sign holder portion adapted to carry a "flag" or sign displaying special information to the consumer, such as identifying a "sale" item or the like. For simplicity, the term "label holder" is used herein to include label holders for adhesive or non-adhesive labels as well as label holders with or without one or more means to also carry a sign or flag.

2. Description of the Related Art

Scanner hook assemblies are commonly found in outlets such as supermarkets, pharmacies and the like, and are often carried by an apertured board or other supporting surface. Generally, scanner hook assemblies at least comprise a pair of interconnected, vertically spaced, horizontally extending, hooks or elements cantilevered forwardly from a proximal mounting portion. The distal end of the upper hook may have a T-shaped cross-bar, a right-angular or L-shaped extension, or a flat scanner plate adapted to carry a label or label holder. The lower hook may be a single, forwardly extending element, a laterally spaced pair of such elements, or a loop for slidable reception and removal of a plurality of products such as plastic encased products with an apertured or slotted cardboard backing commonly known as "blister packs".

Adhesive-backed labels can be secured directly to a flat scanner plate. Removing such adhesive-backed labels is time consuming and difficult, leaving an unsightly residue build-up which is resistant to cleaning. For that reason, non-adhesive paper or plastic labels are generally preferred since they can easily be replaced if they become damaged or the product information changes. Therefore, label holders have been provided which commonly have a back panel with a transparent cover member flexibly secured along one mating edge to the back panel to define a pocket between the front surface of the back panel and the rear surface of the cover member for removable reception of one or more information-containing paper or plastic labels.

Oftentimes, in addition to the information provided by the product labels, it is desired to highlight certain information about a particular product or group of products by displaying an enlarged "flag" or sign. U.S. Pat. No. 6,568,112 (the '112 patent), the subject matter of which is incorporated herein in its entirety by reference, provides a combination label/sign holder wherein the signs are carried by, and move with, the cover member of the label holder and do not interfere with selectively inserting and removing labels from the label holder pocket.

Label holders for attachment to the T-shaped cross-bar, L-shaped right-angular extension or flat plate on the distal end of the upper element of a scanner hook assembly of the type described hereinabove are available. Accidental disengagement of such label holders from the scanner hook assembly is minimized if the label holder can be rotated forwardly and upwardly away from the distal end of the merchandise-receiving hook to access the hook or products carried by the hook. Another problem with attaching a label holder or the like to the distal end of a scanner hook is the possibility of injuring a passerby and/or damaging or disengaging the label holder in the event of an accidental impact from a consumer or even a shopping cart or other piece of equipment.

Thus, it is desirable that the label holder attachment be adapted for both forwardly and rearwardly pivoting movement about its attachment to the scanner hook. Moreover, the ability to temporarily position the label holder in a fixed angular relationship to the scanner hook would be useful to better present information on labels carried thereby to passersby when the scanner hooks are supported at a high or low level.

While some prior art devices have been designed to pivotally support a label holder on the type of scanner hook having a T-shaped cross-bar or an L-shaped right-angular extension on its distal end some such pivoting label holders are relatively complex and expensive to manufacture and use, and many of these designs may be readily disengaged from the scanner hook assembly upon impact.

Moreover, as noted, some scanner hook assemblies have a flat plate rigidly attached to the distal end of the upper element and prior art pivoting label holders are not effective with such constructions. Yet, the ability to tip the label holder forwardly, particularly if it depends below the flat plate portion of the scanner hook assembly, would improve access to the merchandise-receiving hook for loading or removing products therefrom.

SUMMARY OF THE INVENTION

A primary object of this invention is to provide a universal label holder adapted for use with scanner hook assemblies of the type having T-shaped cross-bars, or L-shaped right-angular extensions of different diameters or cross-sections, or even flat plates at their distal end, while enabling hinging movement of the label holder relative to the scanner hook assembly in a simple and inexpensive manner.

A further object of this invention is the provision of a label holder having an upper clip portion to be engaged over or with a T-shaped cross-bar, an L-shaped right-angular extension or a flat plate at the distal end of the upper element of a scanner hook assembly, with a hingedly-connected lower label holder portion which can pivot relative to the clip portion to permit the same to be tipped forwardly or rearwardly when used in association with the T-shaped cross-bar or L-shaped right-angular extension at the distal end of the upper element of scanner hook assemblies having such a construction, and when used in association with a flat plate scanner hook assembly, can be tipped forwardly about the hinge to facilitate access to the merchandise-receiving lower element.

Yet another object of this invention is the provision of a scanner hook label holder of the type described wherein co-extruded strips or stripes of a softer, rubber-like or plastics material are provided at spaced locations interiorly of the clip portion to securely hold the clip portion in fixed relation to T-shaped cross-bars or L-shaped right-angular extensions of different diameters or cross-sections at the distal end of the upper element of a scanner hook assembly, enabling all of the movement of the label holder portion to be controlled by the interconnecting hinge. Thus, the label holder of this invention does not rotate about its attachment to the upper element of a scanner hook assembly, but rotates about an integral or co-extruded hinge interconnecting the relatively fixed attachment of the clip portion to the upper scanner hook element and the label-receiving portion depending therefrom.

A still further object of this invention is to provide a hinged label holder of the type described wherein the flexibility of the material forming the hinge between the label holder portion and the clip portion engaging the scanner hook is controlled to enable the label holder portion to be retained in a fixed angular position relative to the scanner hook until it is manually tipped rearwardly or forwardly.

BRIEF DESCRIPTION OF THE DRAWINGS

These and other objects, features and many of the attendant advantages of this invention will be better understood by those with ordinary skill in the art in connection with the following detailed description of the preferred embodiments and the accompanying drawings wherein.

Like reference characters refer to like parts throughout the several views of the drawings.

DESCRIPTION OF THE PREFERRED EMBODIMENTS

Figure 1:
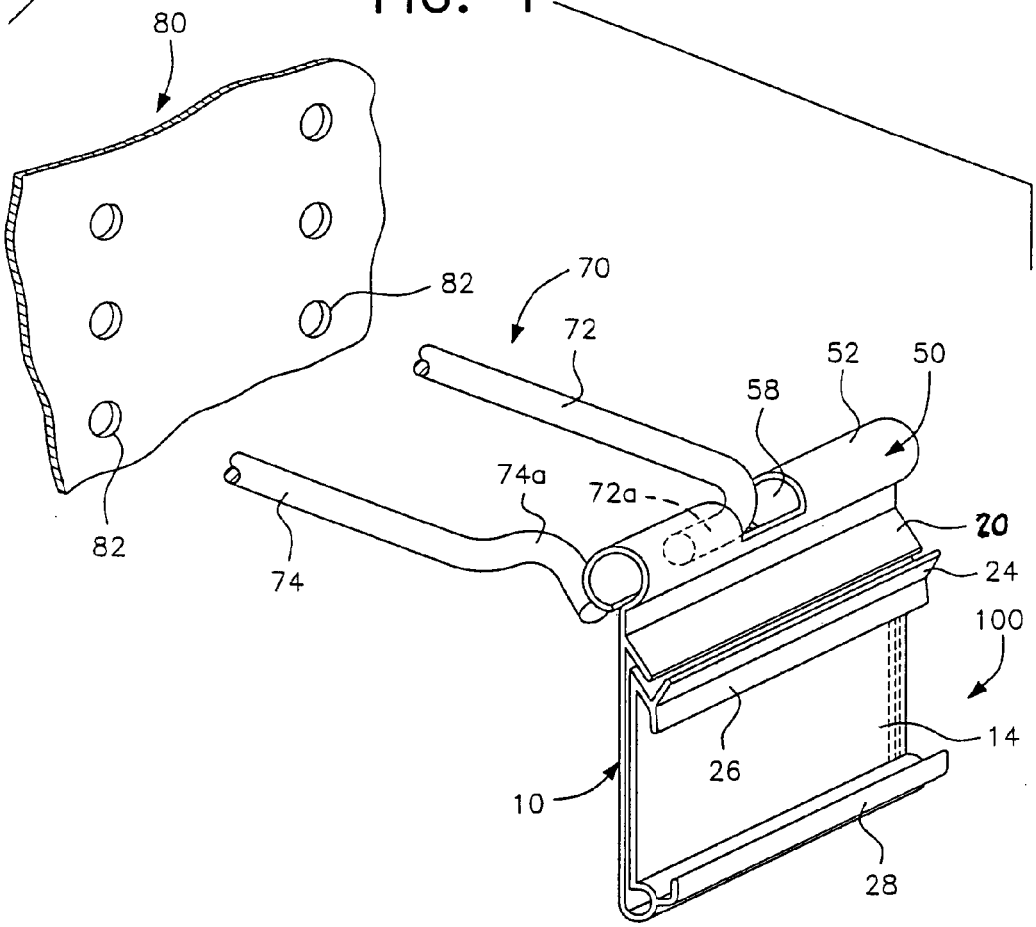
FIG. 1 is an exploded perspective view of relevant portions of one form of scanner hook assembly carrying one embodiment of a label holder according to the instant inventive concepts, with part of a perforated board to carry the same being illustrated.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
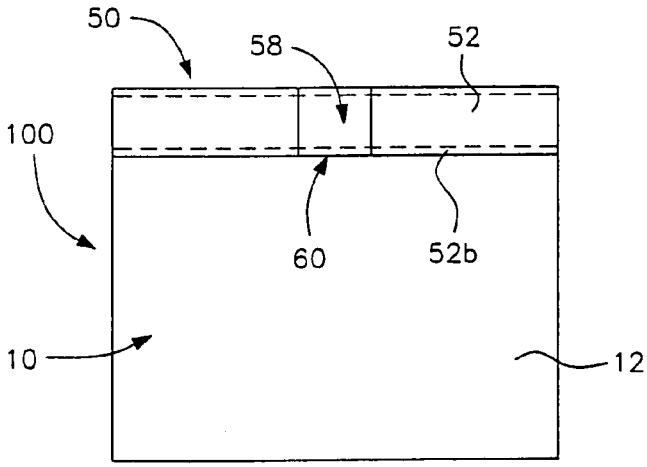
FIG. 2 is a rear elevational view of the label holder of FIG. 1.
Figure 3:
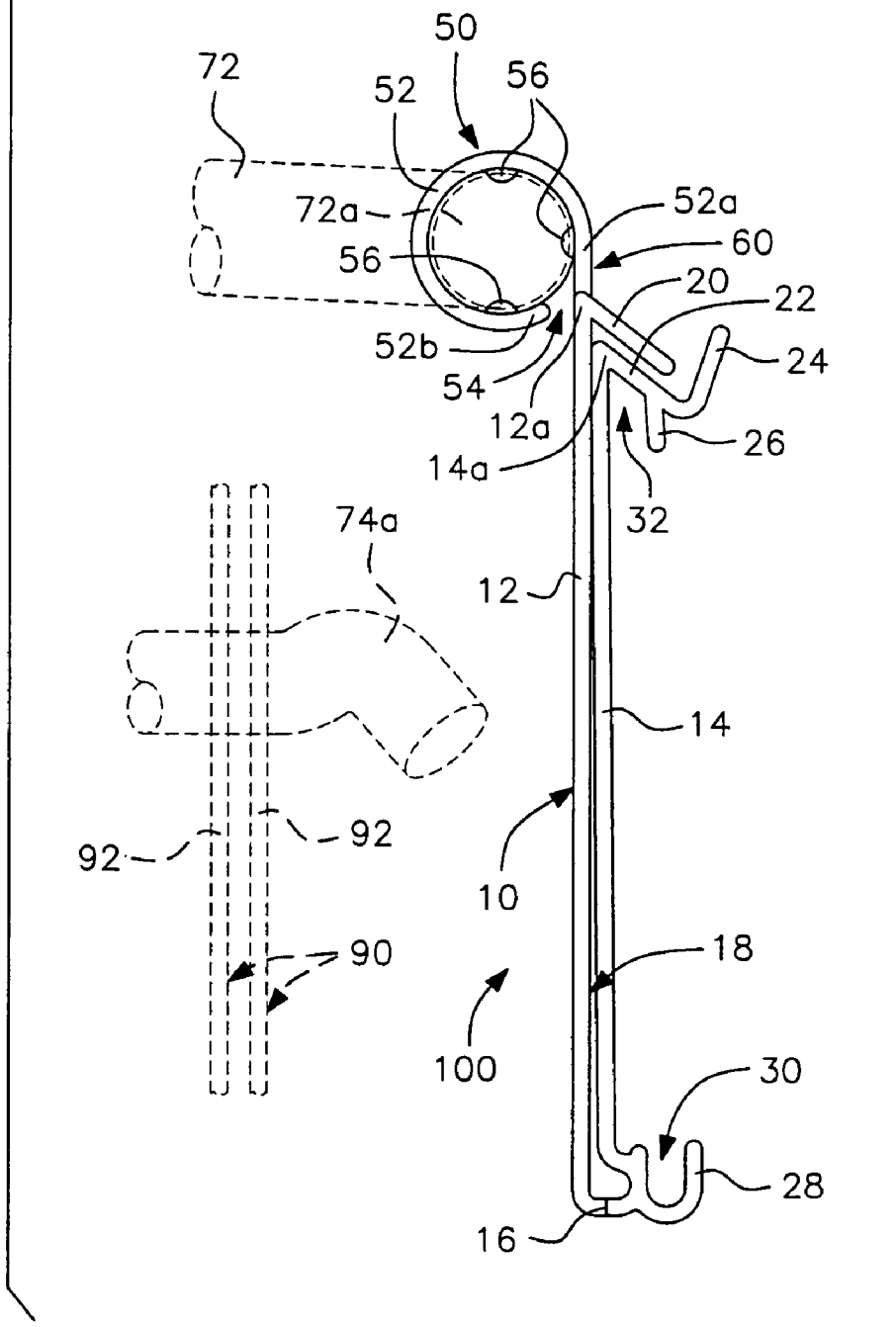
FIG. 3 is an enlarged side elevational view of the label holder of FIG. 1, with portions of a scanner hook assembly and products carried thereby being shown in dotted lines.

Referring now to the drawings in general and more particularly to FIGS. 1–3, a preferred form of label holder according to the instant inventive concepts is designated generally by the reference numeral 100 and comprises two portions, a lower label-receiving or label holder portion 10 and an upper clip portion 50. In the illustrated embodiment, the label holder portion 10 includes a back panel 12 commonly formed of an opaque plastics material such as polyvinyl chloride with a co-extruded transparent front panel or cover member 14. The back panel 12 and the cover 14 are integrally hingedly interconnected at 16 to define between them a pocket 18 for reception of paper or plastic labels or the like (not shown).

In the preferred embodiment of the label holder 100, a downwardly depending ledge 20 is integrally formed at the upper end 12*a* of the back panel 12 and a similar downwardly depending ledge 22 is integrally formed at the upper end 14*a* of the cover member 14, with the flange 22 terminating in an upwardly and forwardly extending finger-engaging element 24. In this manner, when the cover member 14 is biased to its closed position as seen in the drawings, the flange 22 is lockingly engaged under the flange 20 to retain the labels in the pocket 18 and protect the same from dust, moisture and the like. By pressing downwardly and outwardly on the finger-engaging element 24, the cover member 14 can be opened about the hinged connection at 16 to remove or replace the labels.

As discussed hereinabove, the label holder 10 can be a label/sign holder and, to that end, a downwardly depending upper lip 26 and an upwardly extending lower lip 28 are provided to define pockets 30, 32, respectively, for reception of elements of a sign or sign holder (not shown). Further details of this portion of the label holder 10 will be found in the '112 patent incorporated by reference hereinabove. It is to be understood, however, that, while the label/sign holder of the '112 patent is illustrated herein as the preferred form of the label holder portion 10 of the product of the instant invention, other label holders, including those without sign-holding means, can readily be substituted therefor without departing from the instant inventive concepts.

An important feature of the label holder 100 is the clip portion 50 which comprises an arcuate clip member 52 which may be formed of the same or different plastics material as the back panel 12 of the label holder portion 10. The clip portion 50 and the label holder portion 10 are interconnected by a hinge portion 60 commonly formed of a relatively flexible or resilient plastics material such as polyvinyl chloride co-extruded between the top 12*a* of the back panel 12 and one end 52*a* of the arcuate clip member 52.

The other end 52*b* of the arcuate clip 52 is spaced somewhat from the back panel 12 to define therebetween a channel or throat 54 and a plurality of strips or stripes 56 of a relatively resilient or flexible, rubber-like material, such as polyvinyl chloride, are co-extruded at spaced locations about the interior of the arcuate clip member 52.

Portions of one form of a scanner hook assembly are designated generally by the reference numeral 70 and, as shown, comprise an *upper element 72 and a lower element 74. The proximal ends of these elements may be interconnected in any fashion and may include a pair of horns or hook-like elements (not shown) adapted to be engaged in the apertures 82 of an apertured board, portions of which are illustratively shown at 80. The specifics of the scanner hook assembly 70 are not critical to the instant inventive concepts, nor is the supporting surface which carries the same and the apertured board 80, and the particular scanner hook assembly shown at 70 in FIGS. 1–3, are to be considered illustrative only. As noted above, in some forms of scanner hook assemblies, there may be two forwardly extending lower elements or even a looped forwardly extending lower element for reception of slotted openings of portions of a product or its packaging. Further, the proximal ends of some scanner hook assemblies may be adapted to be carried by other forms of supporting surfaces, including C-channels along the forward edge of merchandise-receiving shelves (not shown).

In the illustrated embodiment, the lower element 74 includes an upwardly and downwardly angled distal end 74*a* to retain products such cardboard or plastic backing materials of blister-packed products, illustratively shown at 90, which have apertures as designated at 92. Again, the form of the merchandise-retaining means on the lower element of the scanner plate assembly and the nature of the products carried thereby are not part of the instant inventive concepts.

In the embodiment illustrated in FIGS. 1–3, the upper element 72 of the scanner hook assembly 70 includes a right-angular or L-shaped extension 72*a* at its distal end. In other embodiments of scanner hook assembly, the distal end of the upper element could include a T-shaped cross-bar (not shown) which would interact with the label holder 100 of the instant inventive concepts in a manner similar to that discussed below.

With reference to FIGS. 1 and 2, it should be noted that the arcuate clip member 52 includes a central cut-out portion 58 which extends from a point close to the edge 52*a* of the arcuate clip member 52 all the way to its other end 52*b*. This cut-out enables the arcuate clip member to pass over the L-shaped right-angular extension 72*a* and the juxtaposed rearwardly extending portion of the upper element 72 of the scanner hook assembly 70 in the manner shown, particularly in FIG. 1. If the upper element of the scanner hook assembly 70 included a T-shaped cross-bar, portions would extend in both directions through the cut-out portion 58 into the opposite ends of the arcuate clip member 52.

Although the arcuate clip member 52 surrounds the extension 72*a* of the upper element 72 of the scanner hook assembly 70, once these elements are interengaged, the arcuate element 52 is precluded from rotation with respect to the extension 72*a* by the rubber-like gripping elements or strips 56 so as to fix the relationship of the arcuate clip member 52 against rotation about the L-shaped right angular extension 72*a* of the upper element 72 of the scanner hook assembly 70. Since scanner hooks may be formed of bars of somewhat differing diameters or cross-sectional dimensions or shapes, the thickness and durometer of the gripping elements or strips 56 can be chosen by the skilled artisan to accommodate such reasonable variations in the L-shaped right angular extension or T-shaped cross-bar, insuring non-rotation about the scanner hook element notwithstanding dimensional deviations.

Figure 3A:
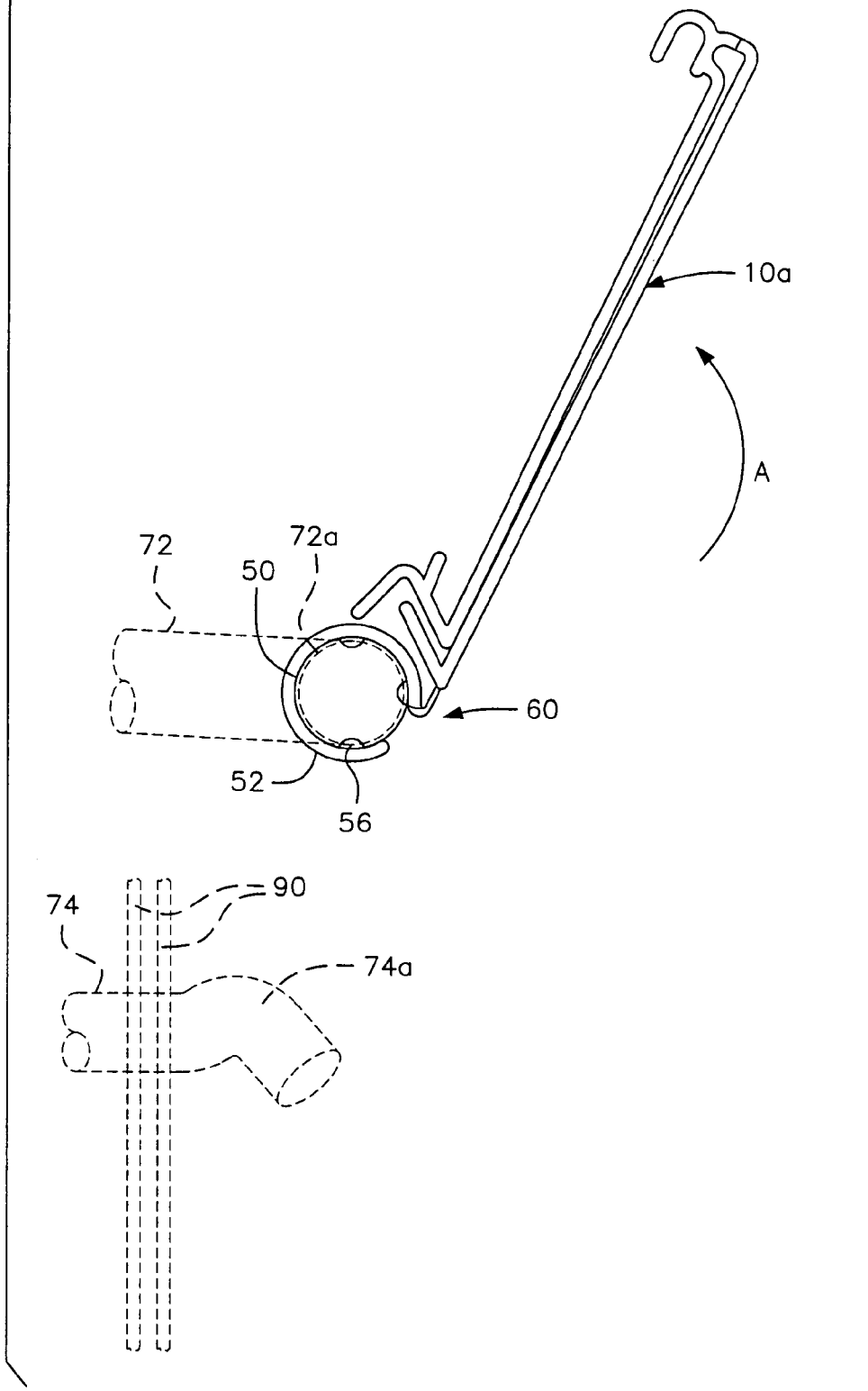
FIG. 3A is a schematic illustration showing the label holder of FIG. 3 pivoted as far upwardly as it can rotate about its hinged connection to facilitate access to products on the lower hook.

The label holder 100 of this invention is provided with a unique hinge section 60 which interconnects the clip portion 50 with the label holder portion 10, enabling the label holder portion 10 to be rotated forwardly and upwardly in the direction of the arrow "A" even to the extreme shown at 10*a* in FIG. 3A to enable ready access to the lower element 74 of the scanner hook assembly 70 to remove products 90 therefrom or to add products thereto. Similarly, in the event of accidental impact on the label holder portion 10, this portion may be tipped rearwardly about the hinge section 60 in the direction of the arrow "B" even to the extreme shown at 10*b* in FIG. 3B. Thus, while retaining a secure engagement between the clip portion 50 of the label holder 100 of this invention and the L-shaped right angular extension 72*a* of the upper element 72 of the scanner hook assembly 70, the label holder portion 10 can be rotated time and again, forwardly or rearwardly, from its normal vertically-extending relationship.

Figure 3B:
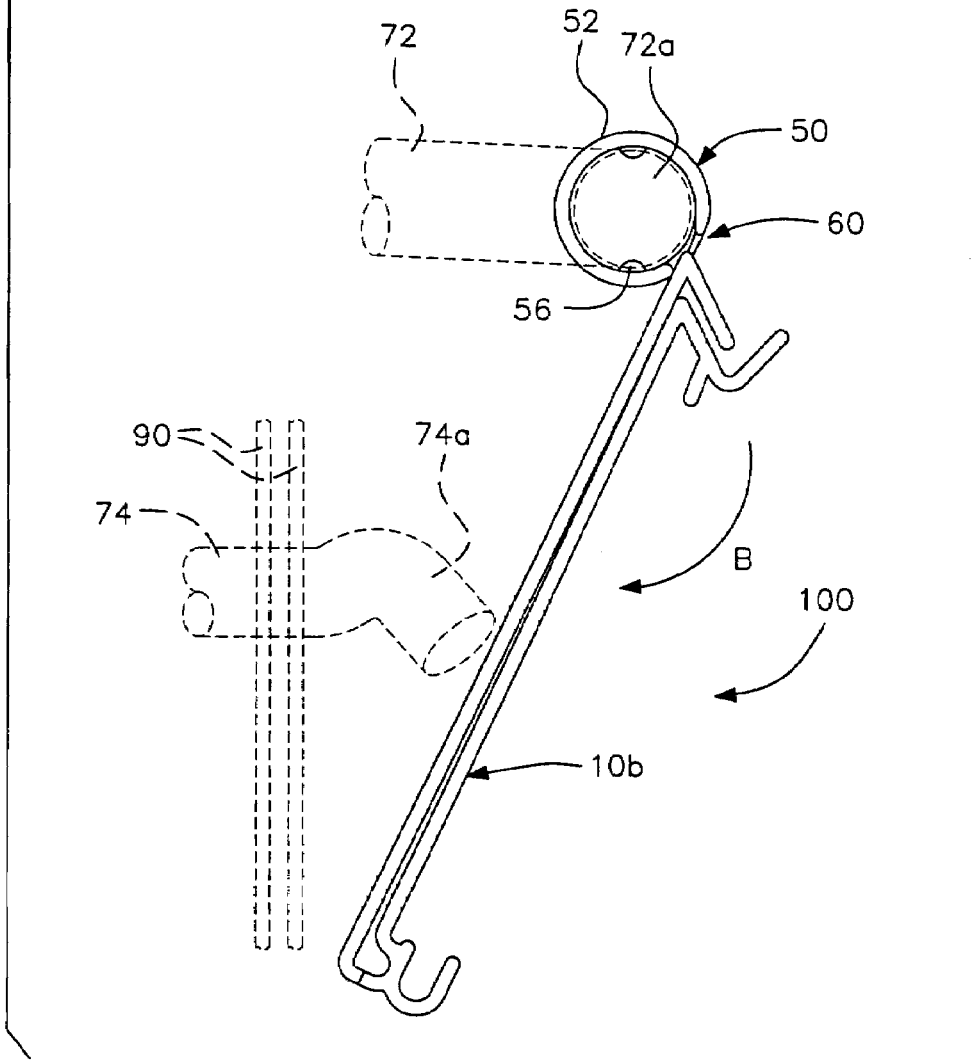
FIG. 3B is a view similar to FIG. 3A with the label holder being pivoted rearwardly about its hinged connection as may occur upon accidental impact.
Figure 3C:
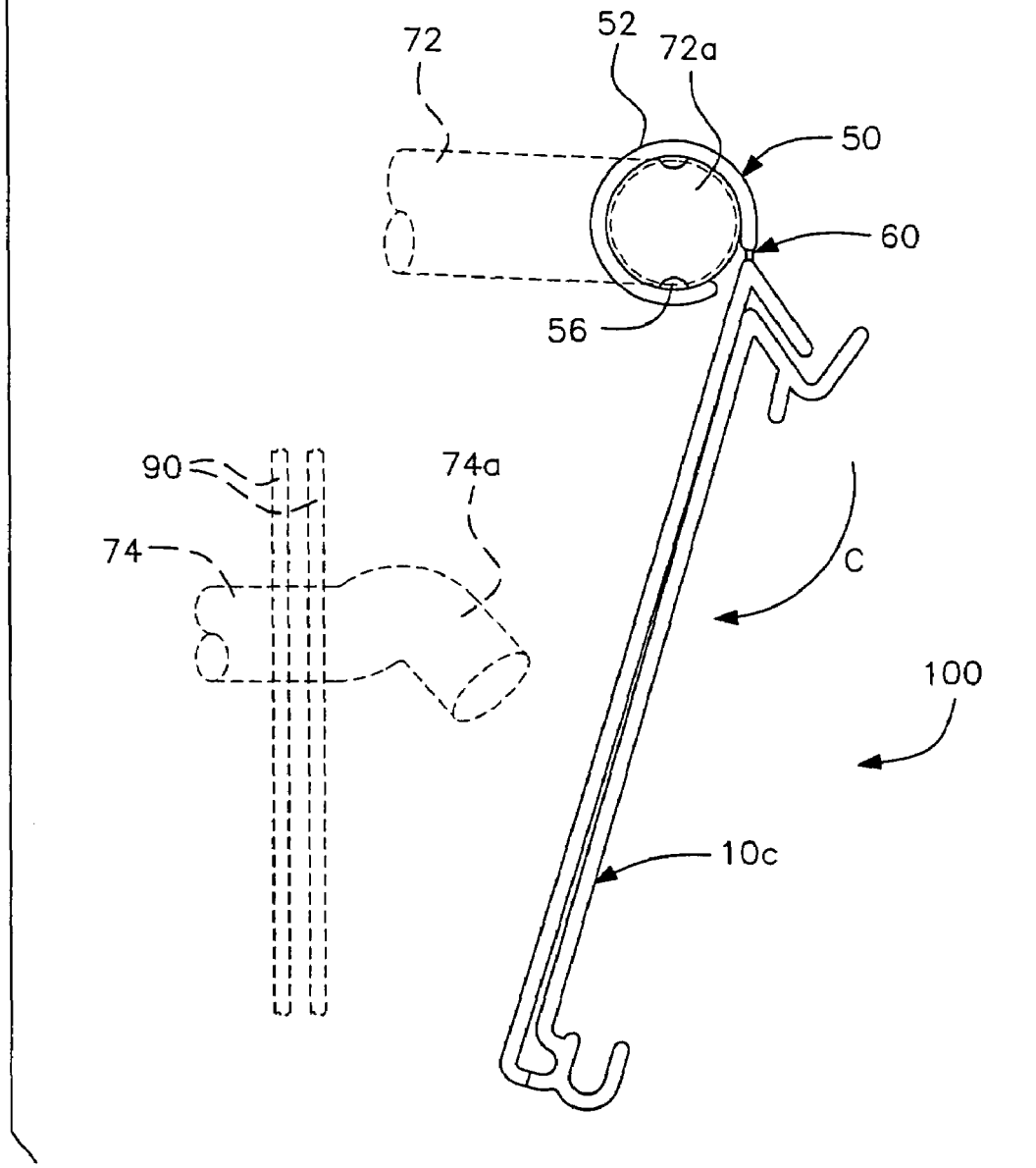
FIG. 3C is a view similar to FIG. 3A with the label holder being pivoted rearwardly about its hinged connection and temporarily retained in that angular position when the label holder is attached to a scanner hook above the eye level of passersby.
Figure 3D:
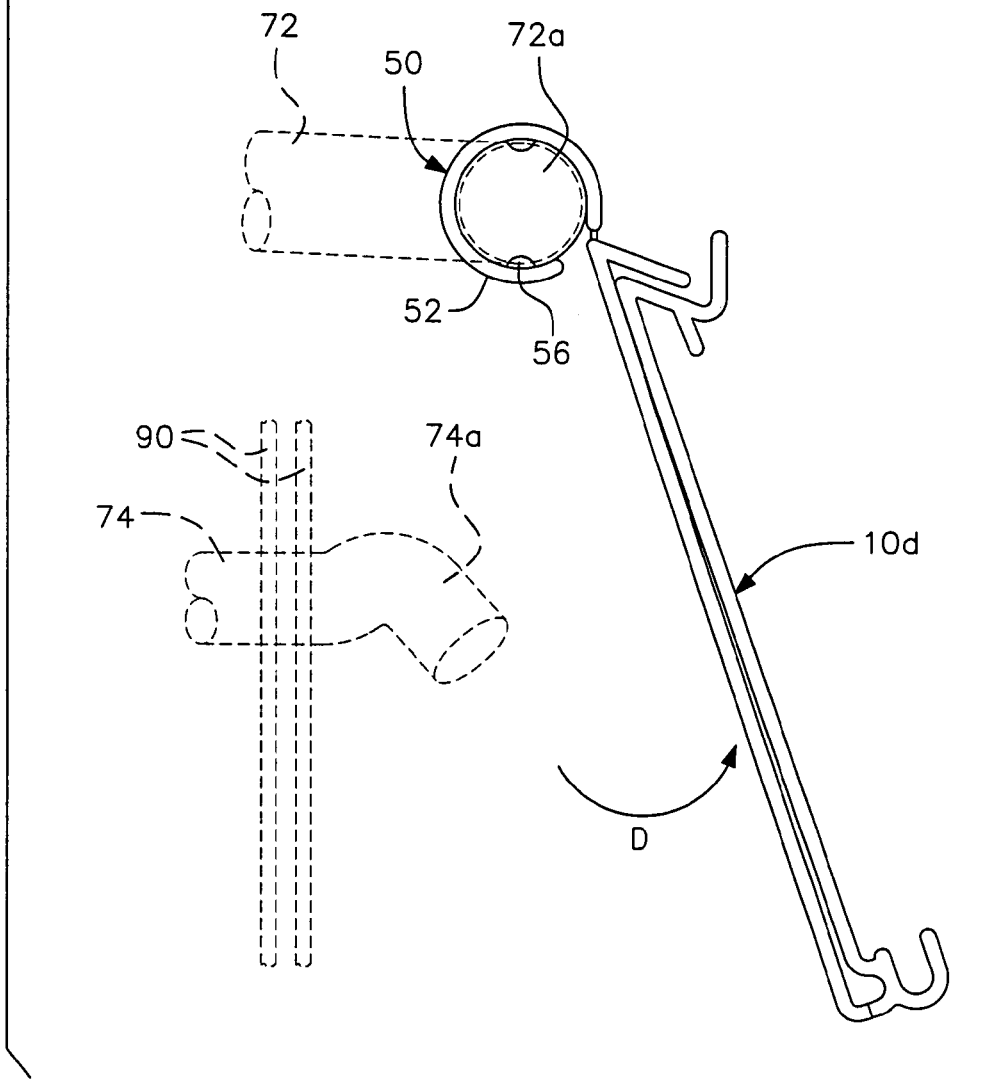
FIG. 3D is a view similar to FIG. 3A with the label holder being pivoted forwardly about its hinged connection and temporarily retained in that angular position when the label holder is attached to a scanner hook below the eye level of a passersby.

Depending upon the flexibility of the hinge section 60, the weight of the label holder portion 10 would normally cause the same to return to its generally vertical position relative to the upper element 72 of the scanner hook 70 once it has been released from the force causing it to rotate to the position seen in either FIG. 3A or FIG. 3B. However, according to a preferred embodiment of the instant inventive concepts, the flexibility of the hinge section 60 is controlled to permit the label holder portion to be temporarily fixed in a selected angular relationship with respect to the scanner hook 70 as seen in FIGS. 3C and 3D. Thus, when the scanner hook is supported relatively high with relation to the eye of a customer or store personnel desiring to "read" the information on a label carried thereby, the label holder portion 10*c* can be rotated about its hinge section 60 in the direction of the arrow "C" in FIG. 3C to temporarily fix the label holder portion 10*c* at a rearwardly-tipped angular position. Similarly, in the event the scanner hook is carried by a support at a level lower than the eye of a customer or store personnel as seen in FIG. 3D, the label holder portion 10*d* can be tipped forwardly in the direction of the arrow "D" about the hinge section 60 to temporarily retain the label holder portion 10*d* in that position.

Those with ordinary skill in this art can select the necessary properties for the hinge section to overcome the effect of gravity on the label holder section and temporarily fix the label holder section at a selected angular relationship with respect to the scanner hook, while enabling the label holder section to be manually reset to another angular relationship, including a substantially vertical relationship with respect to the scanner hook, when appropriate. The flexibility of the hinge section can be adjusted by varying either the thickness, the durometer, or both of the plastics material forming the same. For example, with a label holder of the type seen in the drawings formed of the materials commonly used in the production of such elements, it has been found that a polyvinyl chloride hinge section of a thickness of about 0.020 inch having a durometer of about 75 will maintain the angular position of the label holder portion, yet permit the same to be manually moved in the event of impact, to add or remove merchandise from the scanner hook, or to reposition the angular relationship when the scanner hook is relocated.

In contrast, if a polyvinyl chloride hinge section of the same durometer, but at 0.006 inch thickness is used, the force of gravity will normally return the label holder portion to a vertical position when it is released. Similarly, the use of a 0.020 inch thickness hinge portion of a more flexible polyvinyl chloride will also permit the label holder portion to return to a vertical orientation under the force of gravity.

From the foregoing, it is evident that the ordinary skilled artisan can select the thickness, flexibility and nature of the polymer used in the extrusion of the hinge portion for a particular label holder portion according to the instant inventive concepts to provide the product with the desired characteristics, i.e., the tendency to automatically return to the vertical orientation under the force of gravity upon release of a force rotating the same forwardly or rearwardly, or the ability to be temporarily set and retained in a selected angular relationship with respect to the scanner hook.

Figure 4:
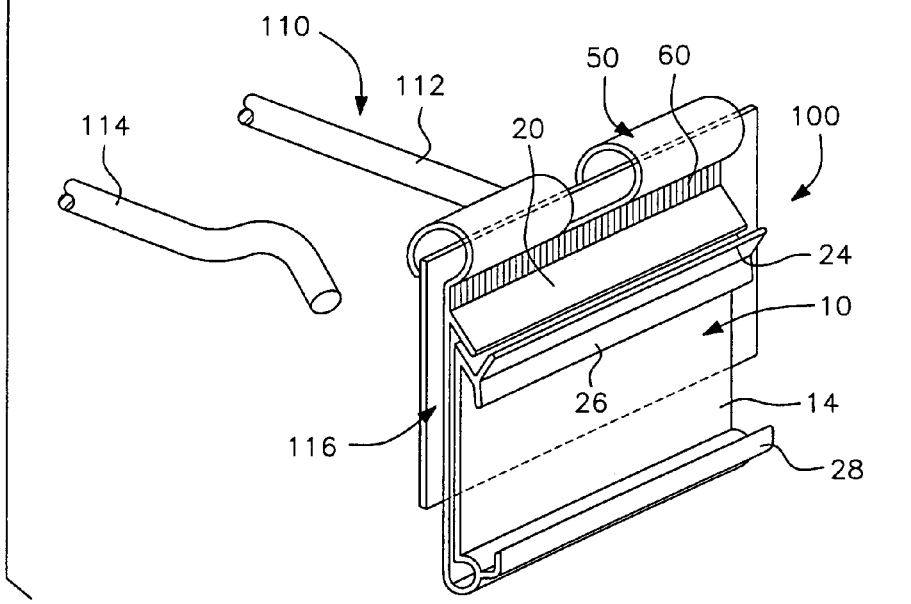
FIG. 4 is a perspective view of the label holder of FIG. 1 carried by a scanner hook assembly having a flat plate fixed to the distal end of the upper element thereof.
Figure 4A:
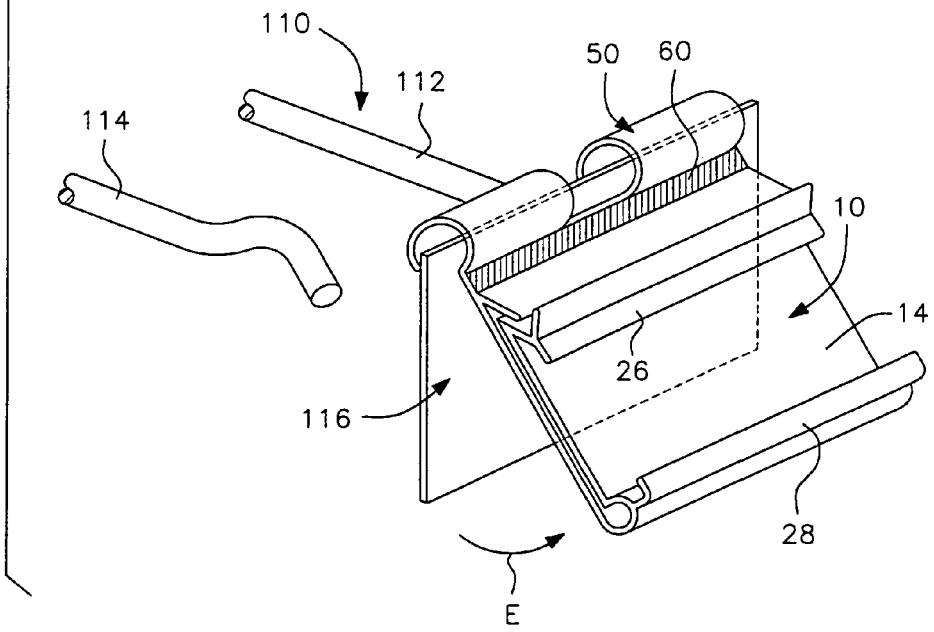
FIG. 4A is a schematic illustration of the label holder of FIG. 4 pivoted upwardly about its hinged connection.
Figure 5:
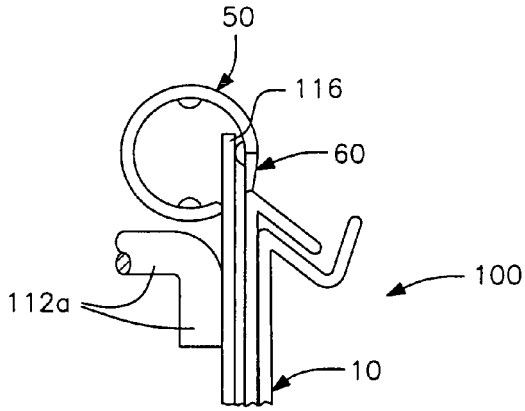
FIG. 5 is a fragmentary, enlarged, side elevational view of the attachment of the label holder to a flat plate scanner hook.

With reference now to FIGS. 4, 4A and 5, the label holder 100 of the instant inventive concepts is shown as used in association with a scanner hook assembly 110 having an upper element 112 and a lower element 114, the design and construction of which may be varied as discussed with respect to the scanner hook assembly 70. However, the scanner hook assembly 110 includes a vertically extending flat scanner plate 114 welded or otherwise attached to the downwardly depending, right-angular extension 112*a* of the upper element 112. With a scanner plate assembly of this type, the flat scanner plate 116 is simply engaged through the throat 54 of the arcuate clip member 52 of the clip portion 50 as seen particularly in FIG. 5, and is engaged between the gripping element 56 and the end 52*b* of the arcuate clip 52 to secure the label holder 100 to the scanner hook assembly 110. Thus, with this construction, the label holder portion 10 of the label holder 100 can still be tilted forwardly in the direction of the arrow E seen in FIG. 4A to facilitate access to the merchandise-receiving lower element 114 of the scanner hook assembly 110, as needed.

Figure 6:
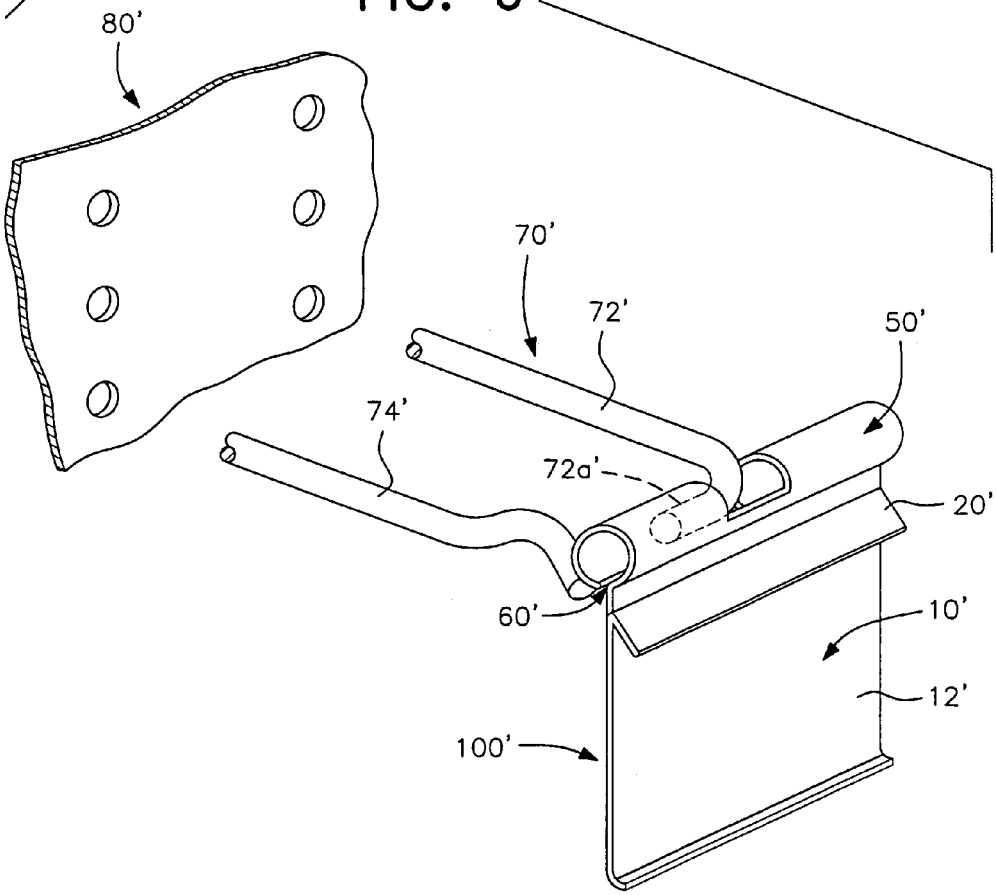
FIG. 6 is a view similar to FIG. 1 showing a modified form of label holder according to this invention adapted for reception of adhesive labels.
Figure 7:
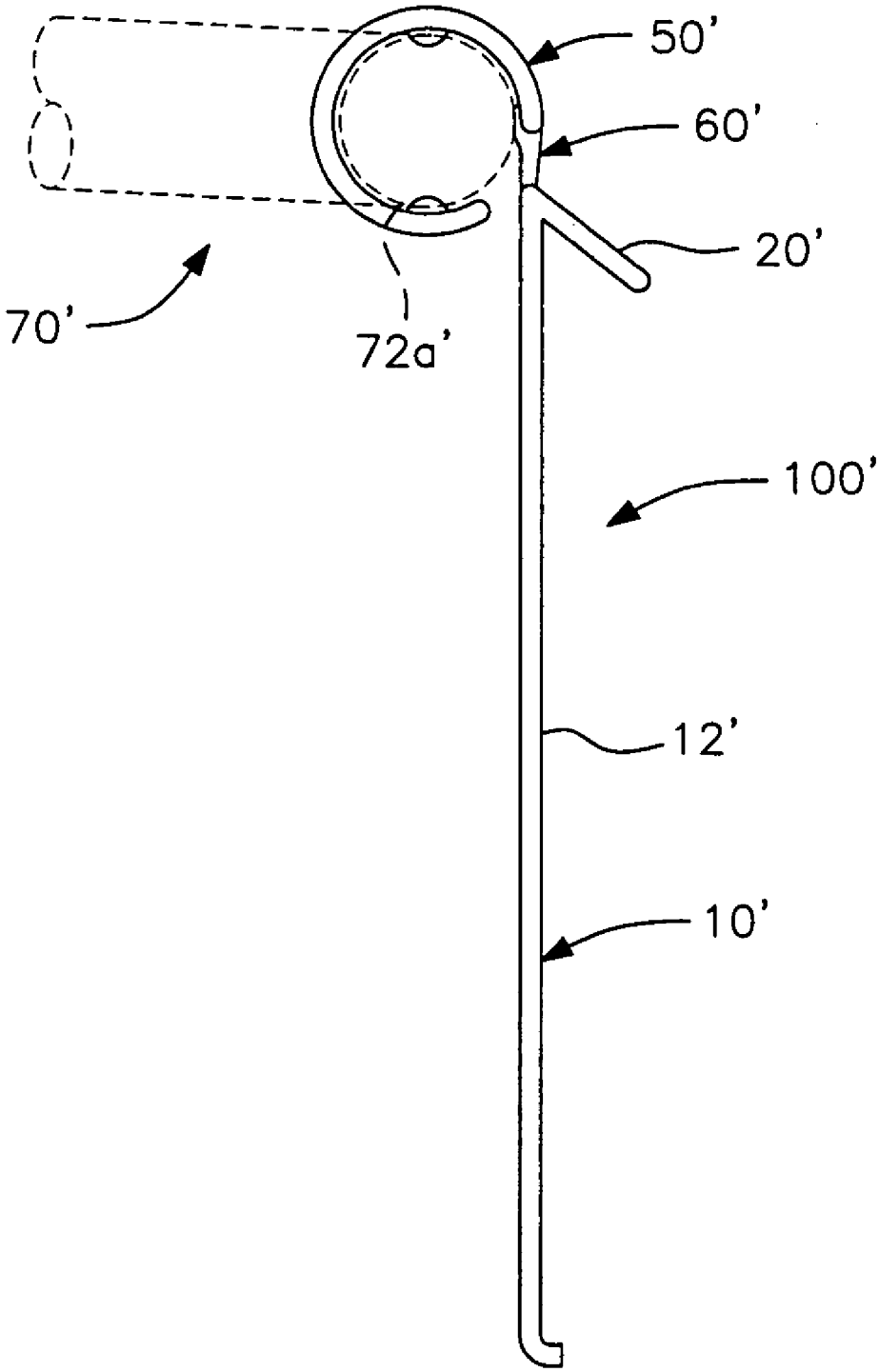
FIG. 7 is a fragmentary side elevational view of the label holder of FIG. 6 attached to a scanner hook assembly shown partially in dotted lines.

A modified and simplified form of label holder according to this invention is illustrated in FIGS. 6 and 7 wherein parts similar to the previous embodiment are designated by the same reference characters followed by a prime (′). The label holder 100′ is identical in construction and function to the label holder 100 with the exception that the cover member is eliminated since the front face of the back panel 12′ of the label holder 100′ is adapted for reception of adhesive labels (not shown). Obviously, this modification is of no import with respect to the ability of the label holder portion 10′ to pivotally move about the hinge portion 60′ with respect to the clip portion 50 when the latter is engaged with a scanner hook assembly 70′, regardless of the structure of the scanner hook assembly.

Considering the foregoing, the use and operation of a label holder according to the instant inventive concepts will be readily understood by those with ordinary skill in the art. Although specific materials are disclosed as preferred, the skilled artisan may readily select other materials that will work equally as well. For example, if it is desired to replace the co-extruded hinge element 60 with an "integral" hinge formed by a thinner connecting portion (not shown) between the label holder back panel and the arcuate clip member, or even a scored hinge portion (not shown), it may be preferred to form the label holder back panel and the arcuate clip member from polypropylene, rather than polyvinyl chloride, since integral hinges formed of polypropylene can better withstand the repeated bending for which the label holder of the instant invention is designed.

Other similar modifications to the disclosed embodiments can also be made within scope of the instant inventive concepts. Thus, the foregoing descriptions and drawings should be considered as illustrative only of the principles of the invention. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

The foregoing descriptions and drawings should be considered as illustrative only of the principles of the invention. As noted, the invention may be configured in a variety of shapes and sizes and is not limited by the dimensions of the preferred embodiment. Numerous applications of the present invention will readily occur to those skilled in the art. Therefore, it is not desired to limit the invention to the preferred embodiments or the exact construction and operation shown and described. Rather, all suitable modifications and equivalents may be resorted to, falling within the scope of the invention.

What is claimed is:

1. A label holder for attachment to a scanner hook assembly, wherein the scanner hook assembly includes at least a scanner hook having a proximal end and a distal end, mounting means on the proximal end of the scanner hook for mounting the scanner hook assembly on a supporting surface with the scanner hook cantilevered forwardly from the supporting surface, and support means on the distal end of the scanner hook for a label holder, said label holder comprising an upper clip portion and a lower label-receiving portion, said clip portion including attaching means for removably securing said label holder to the support means of the scanner hook assembly in a substantially fixed, non-rotatable, relationship with respect to the support means, and a hinge element interconnecting said clip portion to said label-receiving portion of said label holder to permit said label-receiving portion to be moved between a first position in which it depends from said clip portion under the influence of gravity and a second position in which it extends at an angle with respect to said clip portion, said hinge element formed of a flexible material, the flexibility of said material controlled vis-a-vis the combined weight of said label-receiving portion and a label carried thereby to retain said label-receiving portion in said second position against the influence of gravity until said label-receiving portion is manually moved.

2. The label holder of claim 1 wherein said label holder portion comprises a backing member having an upper edge connected to said hinge element and having a front face adapted to support a label.

3. The label holder of claim 2 wherein said label holder further includes a transparent cover member having a front face and a rear face, said backing member and said cover member having lower edges hingedly secured to each other for movement of said cover member between an opened position and a closed position, a label-receiving pocket defined between said front face of said backing member and said rear face of said cover member.

4. The label holder of claim 3 wherein said label holder further includes a latch resiliently securing said cover member to said backing member in said closed position.

5. The label holder of claim 3 further including an upper lip defining a downwardly-opening upper sign-receiving pocket carried by said front face of said cover member, and a spaced lower lip defining an upwardly-opening lower sign-receiving pocket carried by said front face of said cover member.

6. A label holder for attachment to a scanner hook assembly, wherein the scanner hook assembly includes at least a scanner hook having a proximal end and a distal end, mounting means on the proximal end of the scanner hook for mounting the scanner hook assembly on a supporting surface with the scanner hook cantilevered forwardly from the supporting surface, and support means on the distal end of the scanner hook for a label holder, said label holder comprising an upper clip portion and a lower label-receiving portion, said clip portion including attaching means for removably securing said label holder to the support means of the scanner hook assembly in a substantially fixed, non-rotatable, relationship with respect to the support means, and a hinge element interconnecting said clip portion to said label-receiving portion of said label holder to permit said label-receiving portion to be moved between a first position in which it depends from said clip portion under the influence of gravity and a second position in which it extends at an angle with respect to said clip portion, wherein the support means of the scanner hook assembly includes a support element extending generally perpendicularly with respect to the distal end of the scanner hook, and said attaching means of said clip portion of said label holder comprises a resilient clip member having an internal surface engageable about the support element of the scanner hook assembly, and gripping means carried by said clip member adapted to non-rotatably fix said clip member to the support element.

7. The label holder of claim 6 wherein the support element of the scanner hook assembly comprises a right-angular extension at the distal end of the scanner hook, and said clip member is engageable about the right-angular extension.

8. The label holder of claim 6 wherein the support element comprises a generally flat scanner plate fixedly secured at a right angle to the distal end of the scanner hook and having upper edge portions about which said clip member may be resiliently engaged.

9. The label holder of claim 6 wherein said clip member is elongated and includes a central portion with a cut-out to accommodate the distal end of the support hook, and resilient side portions on each side of said cut-out each having freely extending first edge portions, said side portions being resiliently engageable about the support element of the scanner hook assembly, and said clip member including an elongate second edge portion interconnected to said hinge element.

10. The label holder of claim 6 wherein said gripping means comprises at least one section of resilient material carried by said internal surface of said clip member.

11. The label holder of claim 10 wherein said gripping means includes a multiplicity of strips of resilient material spaced about said internal surface of said clip member to enable said clip member to fixedly and non-rotatably secure said clip portion of said label holder about scanner hook elements of different dimensions.

12. In combination, a supporting surface, a scanner hook assembly attached to said supporting surface, and a label holder attached to said scanner hook assembly, said scanner hook assembly including at least a scanner hook having a proximal end and a distal end, mounting means on said proximal end of said scanner hook for mounting said scanner hook assembly on said supporting surface with said scanner hook cantilevered forwardly from said supporting surface, and support means on said distal end of said scanner hook for said label holder, said label holder comprising an upper clip portion and a lower label-receiving portion having a label carried thereby, said clip portion including attaching means removably securing said label holder to said support means of said scanner hook assembly in a substantially fixed, non-rotatable, relationship with respect to said support means, and a hinge element interconnecting said clip portion to said label-receiving portion of said label holder to permit said label-receiving portion to be moved between a first position in which it depends from said clip portion under the influence of gravity and a second position in which it extends at an angle with respect to said clip portion, said hinge element formed of a flexible material, the flexibility of said material controlled vis-a-vis the combined weight of said label-receiving portion and said label to retain said label-receiving portion in said second position against the influence of gravity until said label-receiving portion is manually moved.

13. The combination of claim 12 wherein said supporting surface is a perforated board.

14. The combination of claim 12 wherein said scanner hook assembly further comprises a product-receiving hook spaced below said scanner hook, said product-receiving hook including a distal end closer to said supporting surface than said distal end of said scanner hook.

15. The combination of claim 12 wherein said support means of the scanner hook assembly includes a support element extending generally perpendicularly with respect to said distal end of said scanner hook, and said attaching means of said clip portion of said label holder comprises a resilient clip member having an internal surface engaged about said support element of said scanner hook assembly, and gripping means carried by said clip member non-rotatably fixing said clip member to said support element.

16. The combination of claim 15 wherein said support element of said scanner hook assembly comprises a right-angular extension at said distal end of said scanner hook, and said clip member is engaged about said right-angular extension.

17. The combination of claim 15 wherein said support element comprises a generally flat scanner plate fixedly secured at a right angle to said distal end of said scanner hook and having upper edge portions about which said clip member is resiliently engaged.

18. The combination of claim 15 wherein said clip member is elongated and includes a central portion with a cut-out to accommodate said distal end of said support hook, and resilient side portions on each side of said cut-out each having freely extending first edge portions, said side portions being resiliently engaged about said support element of said scanner hook assembly, and said clip member including an elongate second edge portion connected to said hinge element.

19. The combination of claim 15 wherein said gripping means comprises at least one section of resilient material carded by said internal surface of said clip member.

20. The combination of claim 19 wherein said gripping means includes a multiplicity of strips of resilient material spaced about said internal surface of said clip member to enable said clip member to fixedly and non-rotatably secure said clip portion of said label holder about scanner hook elements of different dimensions.

21. The combination of claim 12 wherein said label holder portion comprises a backing member having an upper edge connected to said hinge element and having a front face, and a label supported by said front face of said backing member.

22. The combination of claim 21 wherein said label holder further includes a transparent cover member having a front face and a rear face, said backing member and said cover member having lower edges hingedly secured to each other for movement of said cover member between an opened position and a closed position, a label-receiving pocket defined between said front face of said backing member and said rear face of said cover member.

23. The combination of claim 22 wherein said label holder further includes a latch resiliently securing said cover member to said backing member in said closed position.

24. The combination of claim 21 further including an upper lip defining a downwardly-opening upper sign-receiving pocket carried by said front face of said cover member, a spaced lower lip defining an upwardly-opening lower sign-receiving pocket carried by said front face of said cover member, and a sign carried by said upper and lower sign-receiving pockets.

* * * * *